US006606088B1

(12) United States Patent
Yang et al.

(10) Patent No.: US 6,606,088 B1
(45) Date of Patent: Aug. 12, 2003

(54) LCD PANEL SIGNAL PROCESSOR

(75) Inventors: Jeffrey Yang, Taoyuan (TW); Justin Liu, Taipei Hsien (TW); Kane Hsu, Taipei (TW); Harchson Wen, Taipei (TW)

(73) Assignee: Mosel Vitelic Inc., Hsinchu (TW)

( * ) Notice: Subject to any disclaimer, the term of this patent is extended or adjusted under 35 U.S.C. 154(b) by 375 days.

(21) Appl. No.: 09/677,930

(22) Filed: Oct. 3, 2000

(30) Foreign Application Priority Data

Jul. 15, 2000 (TW) ..... 89114166 A

(51) Int. Cl.[7] ..... G09G 5/00
(52) U.S. Cl. ..... 345/211; 345/3.1; 345/204
(58) Field of Search ..... 345/204, 3.1, 211, 345/212, 87, 89, 98–100; 348/552, 555, 790

(56) References Cited

U.S. PATENT DOCUMENTS 4,743,096 A * 5/1988 Wakai et al.
4,893,117 A * 1/1990 Blomley et al.
5,091,722 A * 2/1992 Kitajima et al.
5,302,946 A * 4/1994 Shapiro et al.
5,917,552 A * 6/1999 Van Court

* cited by examiner

*Primary Examiner*—Regina Liang
(74) *Attorney, Agent, or Firm*—Birch, Stewart, Kolasch & Birch, LLP

(57) ABSTRACT

An LCD panel signal processor is disclosed. The LCD panel signal processor of the present invention is applied to an LCD panel having a gate driver and a source driver, and comprises: an input interface for receiving plural types of video signals; a micro-processing device for outputting a first control signal which controls the input interface to select a first type video signal from the plural types of video signals, converting the first type video signal into a digital video signal having an output format, and simultaneously sending an information signal to inform a panel controller of the output format. The panel controller receives the digital video signal according to the output format and generates a gate driver signal and a source driver signal for the gate driver and the source driver.

5 Claims, 6 Drawing Sheets

LCD PANEL SIGNAL PROCESSOR

FIELD OF THE INVENTION

The present invention relates to a signal processor. More particularly, it relates to a liquid crystal display (LCD) signal processor.

DESCRIPTION OF THE PRIOR ART

U.S. Pat. No. 5,856,818 discloses a conventional construction of an LCD panel comprising: a graphic controller 1, for generating control signals (Vsync, Hsync, DE, MCLK) and data signals (DATA_EVEN, DATA_ODD), wherein the control signals include a vertical synchronizing signal Vsync, a horizontal synchronizing signal Hsync, a data enabling signal DE, and a main clock MCLK, and the data signals include an even numbered data DATA_EVEN and an odd numbered DATA_ODD; an interface device 2, for controlling a gate driver circuit 3, upper and lower data driver circuits 4 and 5 according to the control signal and the data signal from the graphic controller 1; and an LCD panel 6, which is operated by a gate driver circuit block 3 and upper and lower data driver circuit blocks 4 and 5 (see FIG. 1).

However, since the graphic controller 1 belongs to the LCD module and the interface device 2 belongs to the LCD panel, a matching interface is required.

In the design of a video-signal-input interface, typically only one video signal input is assigned. For example, in U.S. Pat. No. 5,987,543, a conventional input of video signals into notebook computers is disclosed to overcome the EMI (electromagnetic interface) generated from high-speed data transmission by using standard LVDS (low voltage differential signal) in input interface circuits. A peripheral slot is used to receive a single video signal input. The peripheral slot is serially coupled to a video port, an LVDS transmitter, an LVDS receiver, and a display device. Transition minimized differential signal (TMDS) has also been disclosed in the prior art.

U.S. Pat. No. 5,959,601 discloses a display engine used to receive video data and then determine whether the video data is to be displayed on a CRT display or an LCD display. For CRT display, the video data is routed to a digital-to-analog converter which converts the video data into analog signals that present red, green, and blue pixel information. If, however, the video data is intended to be displayed on an LCD display, the video data is provided to an LCD engine.

U.S. Pat. No. 6,025,817 discloses an allocation of signal pins. For example, in a display data channel 1,2 system, 15 pins of a 15-pin D-sub connector correspond to respective signals (a standard connector for standard VGA video output).

The prior art described above discloses that a display device uses an interface circuit to receive digital video data or analog video data, but have not disclosed a method of integrating various interface circuits to receive various types of video data and then select the desired video data. Further, the power-managing design of a conventional LCD panel construction still has room for improvement. On pages 104, 105 of a published book (ISBN 957-817-184-6) related to the most recent LCD application technique, it is described that a bias-voltage generating circuit determines a corresponding drive power by the divided voltage of a variable resistor, and therefore an active adjustment can't be performed according to the direct current power source voltage needed in each internal device. Thus, the effect can't be optimized.

SUMMARY OF THE INVENTION

Accordingly, to solve the above-mentioned problems, the invention provides an LCD panel signal processor applied to an LCD panel having a gate driver and a source driver, comprising: an input interface for receiving plural types of video signals; a micro-processing device for outputting a first control signal which controls the input interface to select a first type video signal from the plural types of video signals, converting the first type video signal into a digital video signal having an output format, and simultaneously sending an information signal to inform a panel controller of the output format, wherein the panel controller receives the digital video signal according to the output format and generates a gate driver signal and a source driver signal for the gate driver and the source driver.

The LCD panel signal processor further comprises a power distributor, for generating at least one direct current, wherein the power distributor is coupled to the pulse-width-modulation-signal-generating device of the micro-processing device so as to control the voltage of the direct current power source via a pulse-width-modulation signal.

BRIEF DESCRIPTION OF THE DRAWINGS

The present invention can be more fully understood from the following detailed description and preferred embodiment with reference to the accompanying drawings in which.

DETAILED DESCRIPTION OF THE PREFERRED EMBODIMENT OF THE INVENTION

In the following description of an LCD panel signal processor, elements of the same function are represented by the same symbol.

Figure 1:
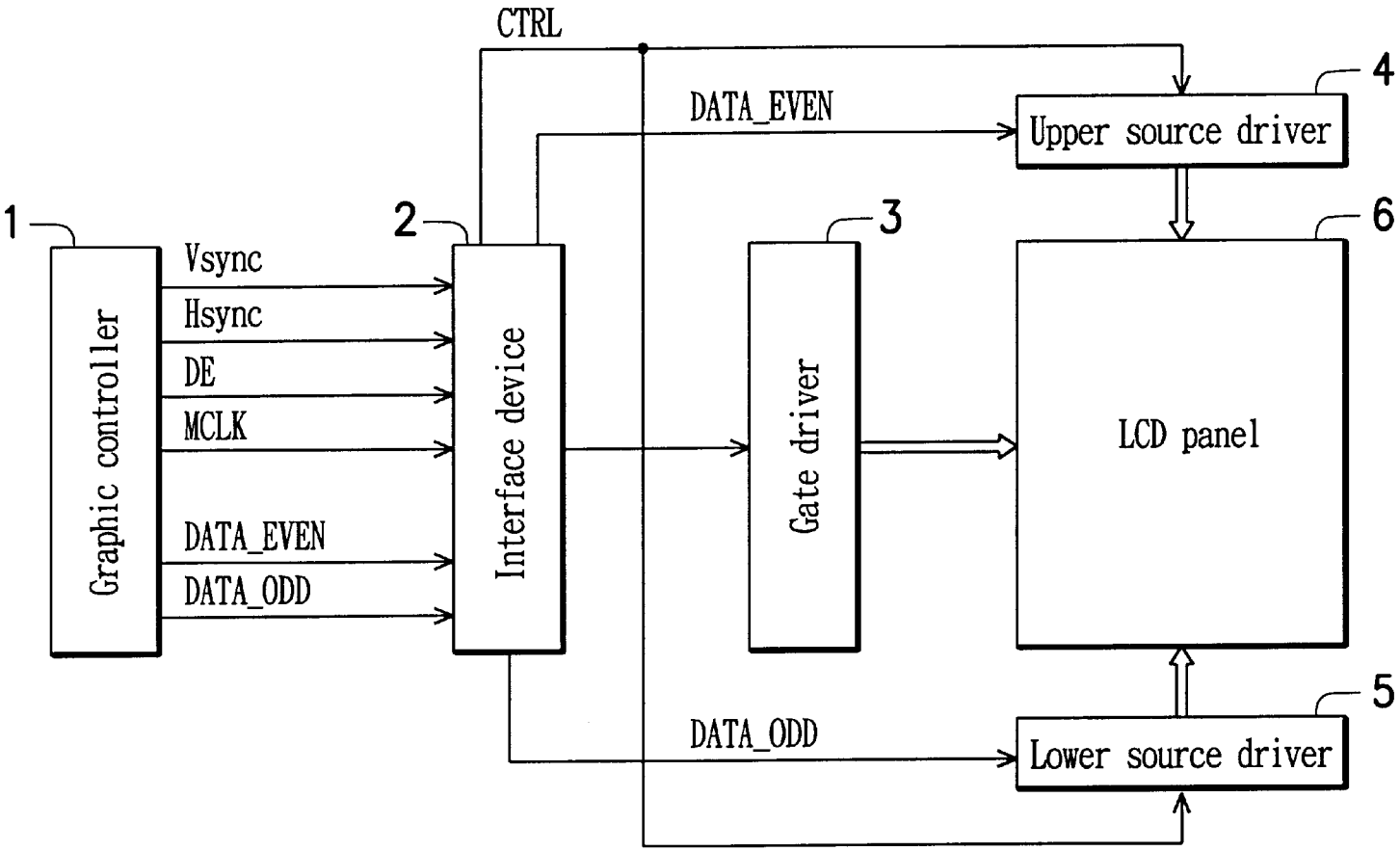
FIG. 1 (PRIOR ART)
FIG. 1 is the construction of a conventional LCD panel.
Figure 2:
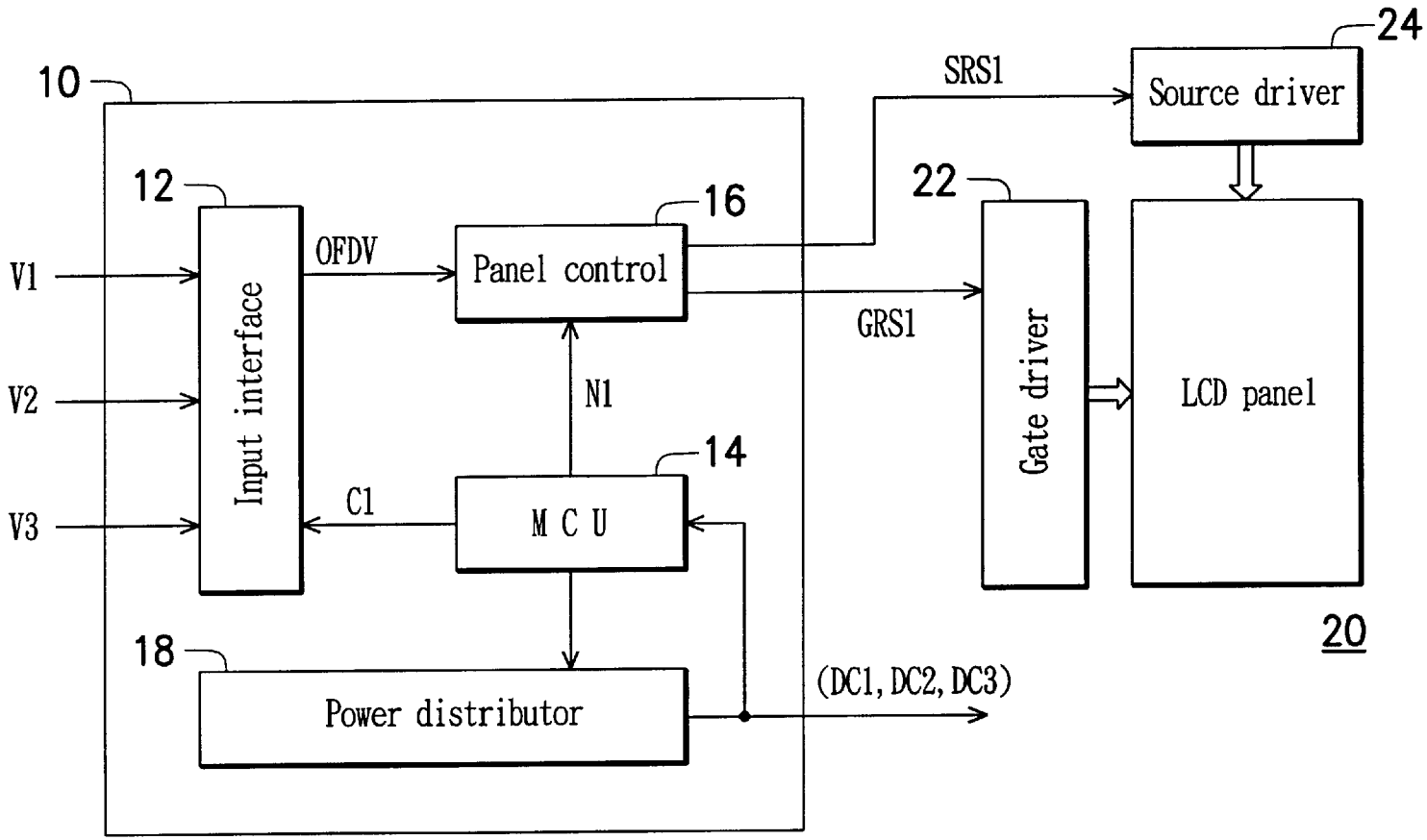
FIG. 2 shows the circuit block diagram of an LCD panel signal processor according to an embodiment of the invention.

Referring to FIG. 2, an LCD panel signal processor 10 is applied to an LCD panel 20 having a gate driver block 22 and a source driver block 24. The LCD panel signal processor 10 comprises the following devices.

Figure 3:
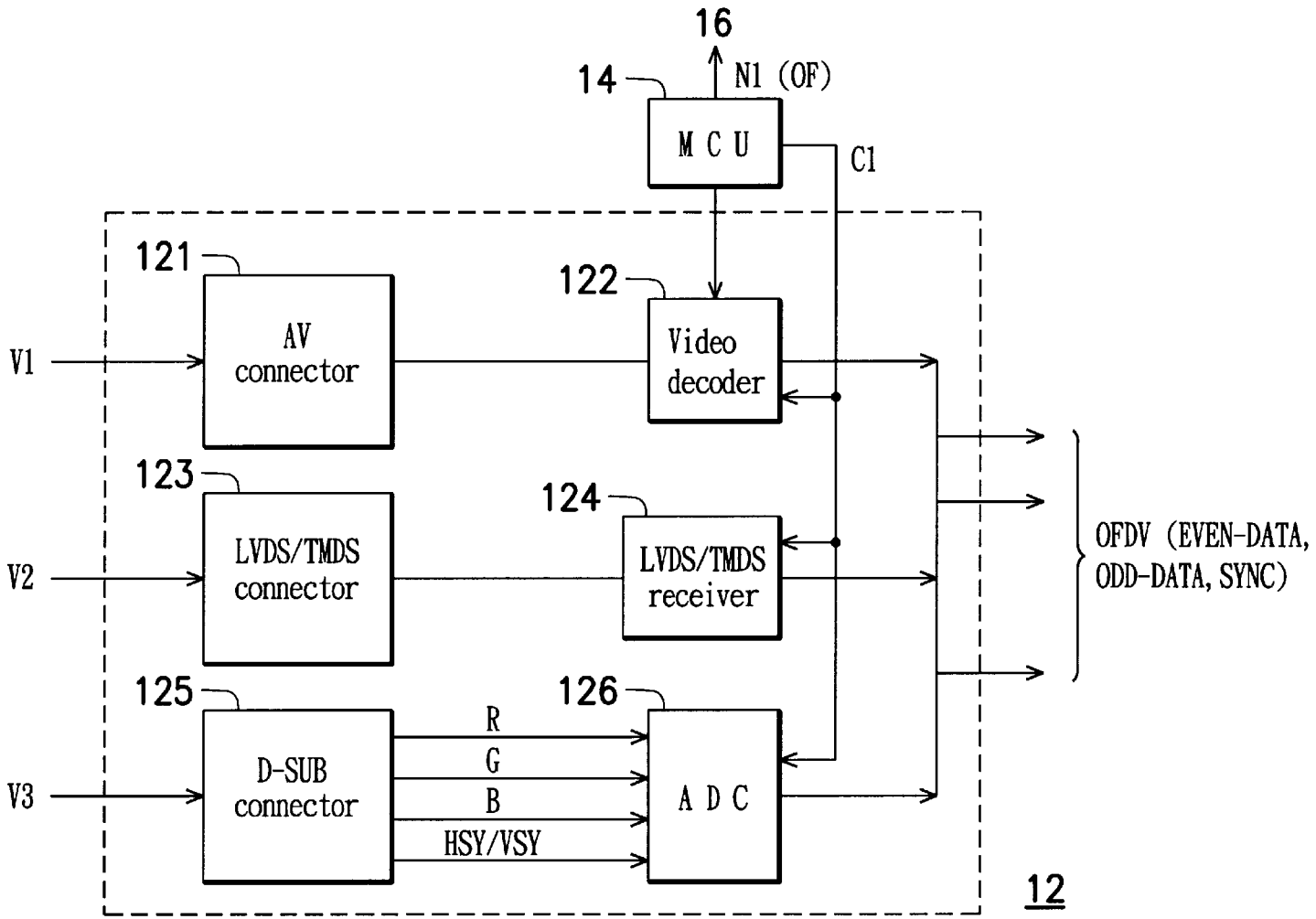
FIG. 3 shows the detailed circuit block diagram of an input interface according to an embodiment of the invention.

First, refer to FIG. 2 and FIG. 3. An input interface 12 integrates a plurality of interfaces for receiving plural types of video signals. Three video signal types are given herein as an example, such as an analog video signal V1, a digital video signal V2, and another analog signal V3. The analog video signal V1, which can be an AV (audio-visual) signal from a TV tunnel box, is transmitted to a video decoder 122 via an AV connector 121. When enabled, the video decoder 122 decodes the AV signal, and generates the digital video signal that corresponds to the output format of the AV signal. The digital video signal V2, which can be a low voltage differential signal from the LVDS/TMDS transmitter of a VGA device, is transmitted to a LVDS/TMDS receiver 124 via a LVDS/TMDS connector 123. When enabled, the LVDS/TMDS receiver 124 receives the low voltage differential signal, thereby generating a digital video signal that has the output format corresponding to the low voltage differential signal. The analog signal V3 transmits, via a 15-pin D-sub connector 125, signals used by standard VGA video outputs corresponding to 15 pins, such as red, blue, and green pixel information R, G, B and a horizontal synchronizing signal and a vertical synchronizing signal, to an analog-to-digital converter ADC 126. When enabled, the analog-to-digital converter ADC 126 converts the analog signal to a digital video signal having an output format corresponding to the analog signal.

A micro-processing device, MCU 14 outputs a first control signal C1 which controls an input interface 12 to select a video signal type from the plural types of video signals, while a first control signal C1 is used to enable one of the video decoder 122, the LVDS/TMDS receiver 124, or the analog-to-digital converter ADC 126. For example, if the analog-to-digital converter ADC 126 is enabled, an analog video signal V3 is converted into a digital video signal OFDV having an output format, e.g., a digital video signal including even data EVEN-DATA, odd data ODD-DATA, synchronizing data SYNC.

The micro-processing device MCU 14 simultaneously sends an information signal N1 to inform a panel controller 16 of the output format OF corresponding to the video signal V3. After receiving the information signal N1, the panel controller 16 receives the digital video signal OFDV according to the output format OF, therefor generating at least a gate driver signal GRS1 and at least a source driver signal SRS1 for the gate driver block 22 and the source driver block 24.

Figure 5:
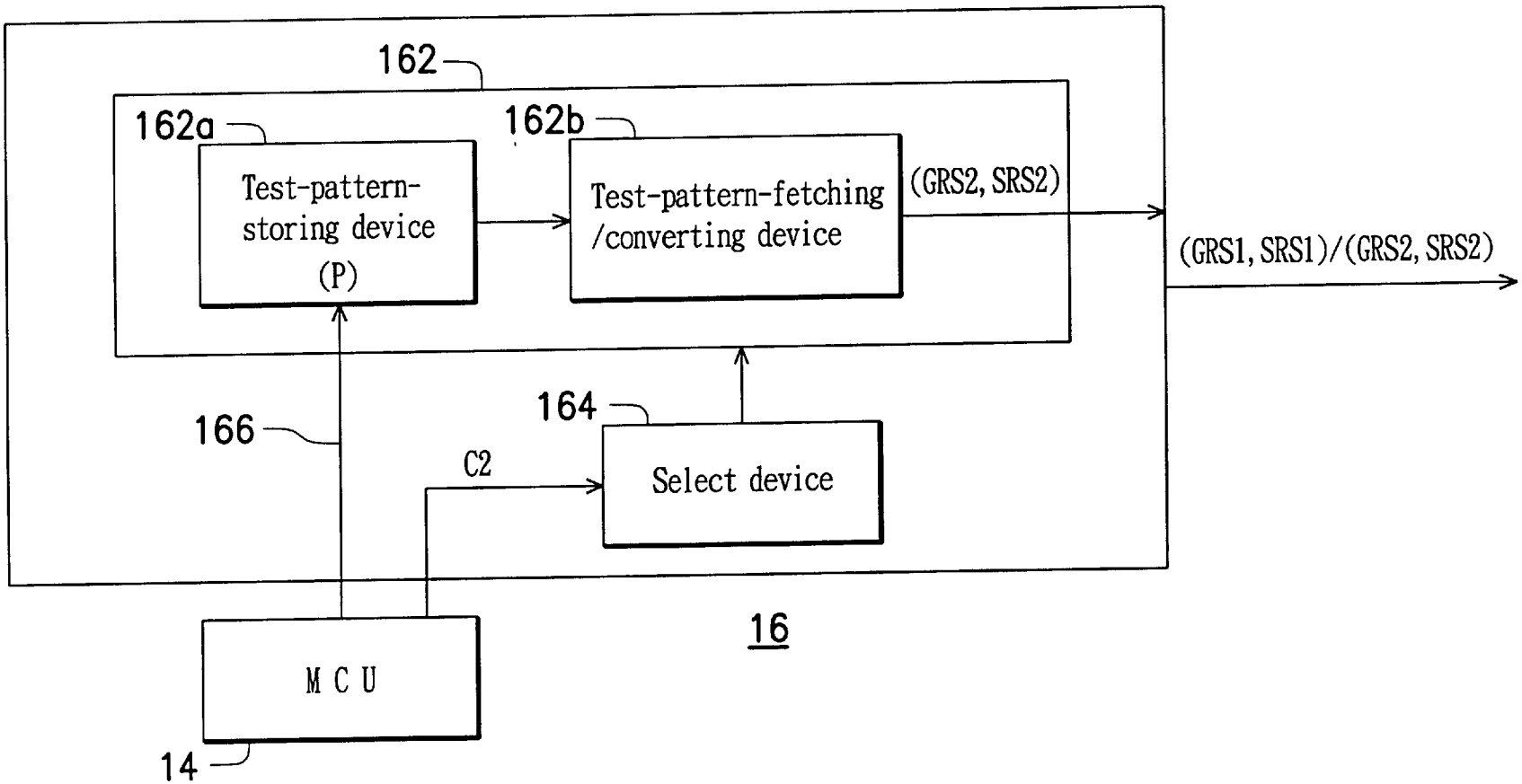
FIG. 5 shows the circuit block diagram of a panel controller according to an embodiment of the invention.

Besides, referring to FIG. 5, the panel controller 16 further comprises a select device 164 and a test-pattern-generating device 162. The following devices can be used to test whether the LCD panel displays normally.

As shown in FIG. 5, the test-pattern-generating device 162 includes: a test-pattern-storing device 162*a*, for example a memory, for storing a plurality of test patterns P; a test-pattern-fetching/converting device 162*b* for fetching one of the plurality of test patterns from the test-pattern-storing device 162*a*, and for converting the fetched test pattern into at least a gate driver signal GRS2 and at least a source driver signal SRS2.

The panel controller 16 further comprises a select device 164, and the micro-processing device MCU 14 outputs a second control signal C2 so as to control the select device 164 to select, for example, the output of the panel controller 16 from at least a gate driver signal GRS1 and at least a source driver signal SRS1 converted by the video signal of the input interface 12; or at least a gate driver signal GRS2 and at least a source driver signal SRS2 converted by test patterns P of the test-pattern-storing device 162*a*.

The micro-processing device refreshes the test patterns stored in the test-pattern-storing device 162*a* via an IIC (Industry Interchip communication) transmission line 166.

Figure 4:
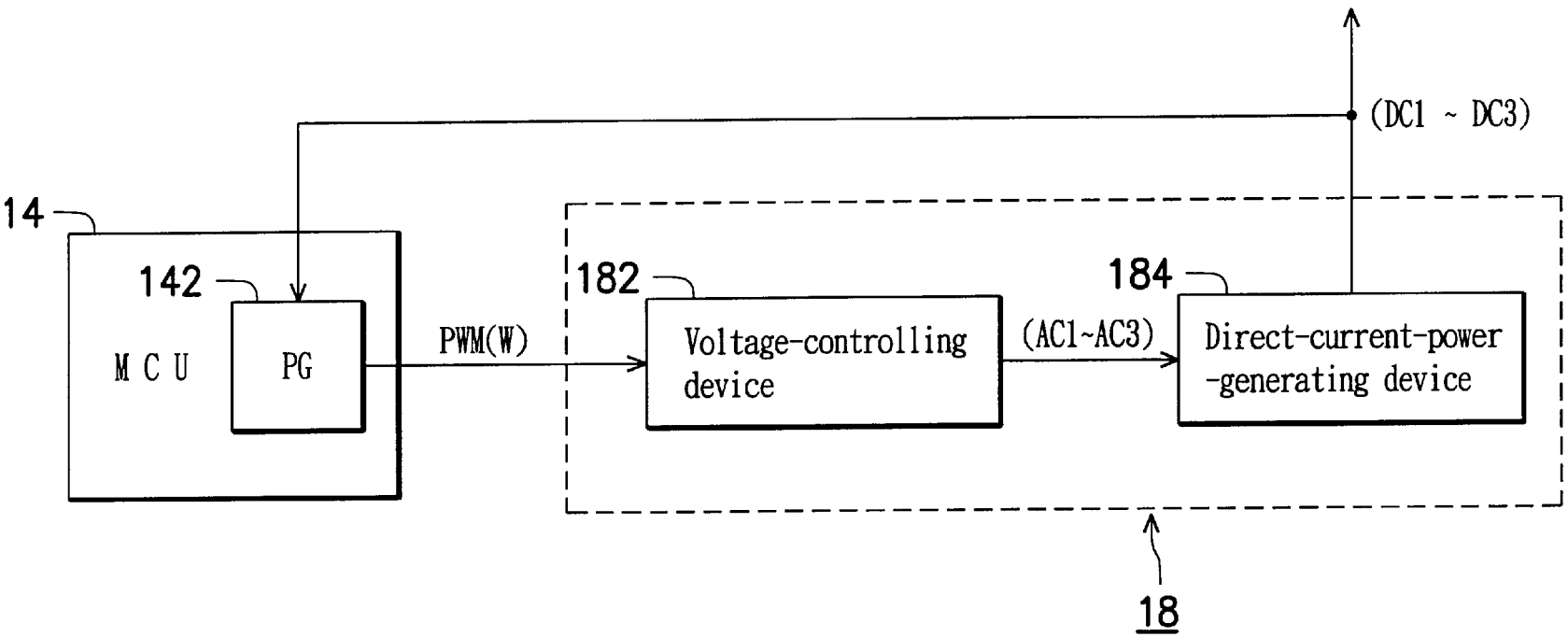
FIG. 4 shows the circuit block diagram of a power distributor according to an embodiment of the invention.

Refer to FIG. 2 and FIG. 4. According to the embodiment, the LCD panel signal processor further comprises a power distributor 18, and the micro-processing device MCU 14 further comprises ac pulse-width-modulation-signal-generating device PG 142 which generates a pulse-width-modulation signal PWM.

The power distributor 18 generates at least one direct-current power source, such as DC1, DC2, DC3. The power distributor 18 is coupled to the pulse-width-modulation-signal-generating device PG142 of the micro-processing device MCU 14, so as to control the voltage values of the direct-current power sources DC1~DC3 via the pulse-width-modulation signal PWM.

The direct-current power sources DC1~DC3 are further fed back to the micro-processing device MCU 14, so as to change the pulse width(W) of the pulse-width-modulation signal PWM according to the voltage values of direct-current power sources DC1~DC3. Thus, the pulse-width-modulation-signal-generating device PG142 can control the voltage values of the direct-current power sources DC1~DC3 by the pulse width(W) of the pulse-width-modulation signal PWM.

FIG. 4 illustrates an embodiment of the power distributor 18, which comprises a voltage-controlling device 182 and a direct-current-power-generating device 184. The voltage-controlling device 182 outputs at least an alternating current voltage, such as AC1~AC3, according to a power voltage, such as 3.3/5V, wherein the voltage-controlling device 182 is coupled to the pulse-width-modulation-signal-generating device 142 of the micro-processing device 14 so as to adjust the voltage values of the alternating current voltages AC1~AC3 via the pulse-width-modulation-signal PWM.

The direct-current-power-generating device 184 converts the alternating current voltages AC1~AC3 so as to generate direct current power sources DC1~DC3 that correspond to the voltage values of the alternating current voltages AC1~AC3.

Figure 6:
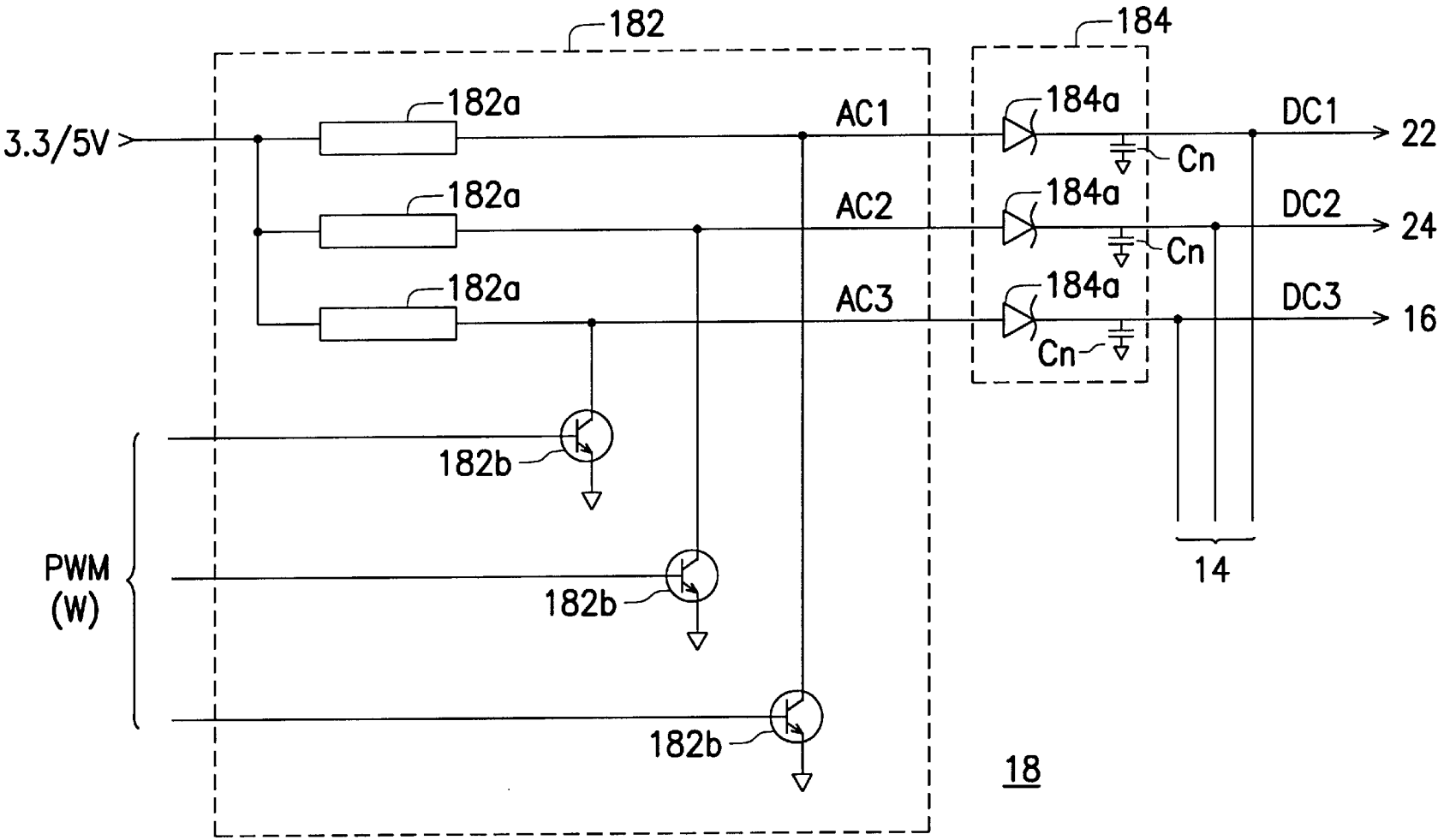
FIG. 6 shows the detailed circuit block diagram of a power distributor according to an embodiment of the invention.

Refer to FIG. 6, which further illustrates the voltage-controlling device 182 and the direct-current-power-generating device 184. The voltage-controlling device 182 includes at least a transistor 182*b* and an inductance 182*a*. For example., one terminal of the inductance 182*a* receives a power voltage 3.3V/5V and the other terminal is coupled to the transistor 182*b*, so as to generate alternating current voltage AC1~AC3. The pulse-width-modulation-signal PWM adjusts the voltage value of the alternating current voltage AC1~AC3 by switching (the base of) the transistor 182*b*. The direct-current-power-generating device 184 consists of at least a schottky diode 184*a* which is generally further coupled to a grounded capacitor Cn, and the alternating current voltages AC1~AC3 generate the corresponding direct-current power sources DC1~DC3 via the schottky diodes 184*a*. The direct-current power sources DC1~DC3 are provided for the gate driver 22, the source driver 24, and the panel controller 16, respectively, and are fed back to the micro-processing device 14.

According to FIG. 6, one terminal of the inductor 182*a* receives a power voltage, the other terminal is coupled to the collector of the transistor 182*b*, the emitter of the transistor 182*b* is grounded, and the base of the transistor 182*b* is coupled to the pulse-width-modulation-signal-generating device PG142, so as to control the switching of the transistor 182*b* via the pulse-width-modulation-signal PWM.

In addition, in the above-mentioned embodiment, the LCD panel signal processor 10 can be integrated using integrated circuits. For example, the micro-processing device MCU 14 and the power distributor 18 can be realized using the IC NO. SM51C48D1, and the input interface 12 and the panel controller 16 can be realized using the IC NO. SM32X01.

While the invention has been described with reference to an illustrative embodiment, the description is not intended to be construed in a limiting sense. Various modifications of the illustrative embodiment, as well as other embodiments of the invention, will be apparent to those persons skilled in the art upon reference to this description. It is therefore contemplated that the appended claims will cover any such modifications or embodiments as may fall within the scope of the invention defined by the following claims and their equivalents.

What is claimed is:

1. An LCD panel signal processor for an LCD panel having a gate driver and a source driver, comprising:

an input interface for receiving plural video signal types;

a micro-processing device for outputting a first control signal, instructing the input interface to select a first type video signal from the plural video signal types, converting the first type video signal into a digital video signal having an output format, and simultaneously sending an information signal comprising the output format; wherein the micro-processing device comprises a pulse-width-modulation-signal-generating device, for generating a pulse-width-modulation signal;

a panel controller for receiving the information signal to receive the digital video signal according to the output format, and generating a first gate/source driver signal set for the gate driver and the source driver; and a power distributor, for generating at least a direct current power source, wherein the power distributor is coupled to the pulse-width-modulation-signal-generating device to control the voltage value of the direct current power source via the pulse-width-modulation signal wherein said direct current power sources are further fed back to said micro-processing device, to change the pulse width of said pulse-width-modulation signal according to the voltage value of said direct current power source.

2. The LCD panel signal processor as claimed in claim 1, wherein said pulse-width-modulation-signal-generating device uses the pulse width of said pulse-width-modulation signal to control the voltage value of said direct current power source.

3. The LCD panel signal processor as claimed in claim 1, wherein said power distributor comprises:

a voltage-controlling device for outputting an alternating current voltage according to a power voltage, wherein said voltage-controlling device is coupled to said pulse-width-modulation-signal-generating device of said micro-processing device to control the voltage value of said alternating current voltage via said pulse-width-modulation signal; and a direct-current-power-generating device for converting said alternating current voltage so as to generate at least one direct current power source that corresponds to the voltage value of said alternating current voltage.

4. The LCD panel signal processor as claimed in claim 3, wherein said voltage-controlling device comprises:

at least a transistor; and an inductor, one terminal of which is coupled to said power voltage, and the other terminal of which is coupled to said transistor so as to generate an alternating current voltage, wherein said pulse-width-modulation signal adjusts the voltage value of said alternating current voltage via the switching of said transistor.

5. The LCD panel signal processor as claimed in claim 4, wherein said direct-current-power-generating device consists of at least a schottky diode.

* * * * *